US011986081B1

(12) United States Patent
Ma

(10) Patent No.: US 11,986,081 B1
(45) Date of Patent: May 21, 2024

(54) AIR-COOLED NEGATIVE ION HAIR CURLER

(71) Applicant: Wansong Ma, Nanyang (CN)

(72) Inventor: Wansong Ma, Nanyang (CN)

(73) Assignee: Wansong Ma, Nanyang (CN)

( * ) Notice: Subject to any disclaimer, the term of this patent is extended or adjusted under 35 U.S.C. 154(b) by 0 days.

(21) Appl. No.: 18/496,479

(22) Filed: Oct. 27, 2023

(30) Foreign Application Priority Data

Oct. 25, 2023 (CN) ..... 202322859252.7

(51) Int. Cl.
*A45D 6/20* (2006.01)
*A45D 1/04* (2006.01)

(52) U.S. Cl.
CPC *A45D 6/20* (2013.01); *A45D 1/04* (2013.01)

(58) Field of Classification Search
CPC ..... A45D 1/00; A45D 1/02; A45D 1/04; A45D 1/06; A45D 1/10; A45D 1/16; A45D 1/20; A45D 1/28; A45D 2001/008; A45D 2/00; A45D 2/001; A45D 6/02; A45D 6/12; A45D 20/10; A45D 20/50; A45D 20/122
USPC ..... 401/137, 138, 139; 132/222, 223, 224, 132/269, 272
See application file for complete search history.

(56) References Cited

FOREIGN PATENT DOCUMENTS

| | | | | |
|---|---|---|---|---|
| CN | 107632640 | A | | 1/2018 |
| CN | 210672436 | U | | 6/2020 |
| CN | 214382251 | U | | 10/2021 |
| CN | 217959100 | U | * | 12/2022 |
| JP | 2018166896 | A | * | 11/2018 |
| WO | WO-2020093756 | A1 | * | 5/2020 |

OTHER PUBLICATIONS

JP2018166896A. Translation (Year: 2018).*
WO2020093756A1. Translation (Year: 2020).*
CN217959100U. Translation (Year: 2022).*

* cited by examiner

*Primary Examiner* — Cris L. Rodriguez
*Assistant Examiner* — Karim Asqiriba
(74) *Attorney, Agent, or Firm* — Nitin Kaushik

(57) ABSTRACT

The utility model relates to the technical field of hairdressing tools, and discloses an air-cooled negative ion hair curler with a negative ion channel and good shaping. The air-cooled negative ion hair curler comprises a housing, a driving mechanism, a hair curling mechanism, a heating assembly, and a fan assembly. An air supply channel is disposed in an inner hollow structure of the housing. A negative ion airflow delivered by the fan assembly cools the hair on the heating assembly through the air supply channel.

16 Claims, 9 Drawing Sheets

AIR-COOLED NEGATIVE ION HAIR CURLER

CROSS-REFERENCE TO RELATED APPLICATIONS

The application claims priority to Chinese patent application No. 2023228592527, filed on Oct. 25, 2023, the entire contents of which are incorporated herein by reference.

TECHNICAL FIELD

The utility model relates to the technical field of hairdressing tools, and in particular, to an air-cooled negative ion hair curler.

BACKGROUND

The automatic hair curling iron is a commonly used hairdressing tool in daily life. It has the effects of fast heating, stable temperature, and good styling. Hair styling with a curling iron means to wrap the hair around the heated rod first, wait for a few to ten seconds to curl the hair with the high temperature of the rod, and then remove the curled hair from the rod. After the hair cools, it forms a curved styling effect. In the above process, after the rod curls the hair with the high temperature, cooling the hair quickly and effectively is the key factor to obtain ideal and long-lasting styling as well as protect the hair.

As for the curling irons currently seen on the market, after the hair is curled through the rod with high temperature, the hair is removed from the rod and cooled naturally. As there is no other fast and efficient cooling method, the styling effect of the hair is not long-lasting; in addition, many curling irons are equipped with a negative ion function. Negative ions can "neutralize" the electrostatic particles generated during high-temperature styling, making the hair smoother and less frizzy. However, these curling irons am not designed to diffuse or transport negative ions, thus the negative ions can only accumulate at the generator, which is difficult to spread the negative ions effectively to the hair.

SUMMARY

The technical problem to be solved by this utility model is that as the hair curling iron in the prior art has no design of negative ion diffusion and transportation, the negative ions can only be accumulated at the location of the generator and cannot effectively diffuse to the hair, the utility model provides an air-cooled negative ion hair curler with a negative ion channel and good styling.

The technical solution adopted by this utility model to solve the technical problem is to construct an air-cooled negative ion hair curler, comprising:

- a housing of which an inner hollow structure is formed inside and an open structure is disposed at an upper end;
- a driving mechanism arranged in the inner hollow structure of the housing and configured to output left and right rotational torques;
- a hair curling mechanism arranged at an upper end of the driving mechanism and in transmission connection with the driving mechanism;
- a heating assembly arranged above the driving mechanism and configured to generate heat for hair to be heated; and

- a fan assembly arranged on one side of the housing and configured to form an airflow; wherein,
- an air supply channel is disposed in the inner hollow structure of the housing, and a negative ion airflow delivered by the fan assembly cools the hair on the heating assembly through the air supply channel.

In some embodiments, one side of the air supply channel is disposed adjacent to the fan assembly, and another side of the air supply channel is disposed adjacent to the hair curling mechanism.

In some embodiments, the air-cooled negative ion hair curler further comprises a negative ion generator.

The negative ion generator is fixed on an air outlet side of the fan assembly. When the airflow delivered by the fan assembly flows, the airflow takes away the accumulated negative ions to form negative ionic wind.

In some embodiments, the housing is provided with at least a curling chamber, a driving mechanism chamber, and a controller chamber for placing a controller.

The heating assembly is arranged in the curling chamber.

The driving mechanism is arranged in the driving mechanism chamber.

In some embodiments, a terminal of the fan assembly is electrically connected with the controller and controlled by the controller. After preset time for preheating the hair wrapped around the heating assembly reaches, the fan assembly is controlled to rotate to drive the airflow, and the airflow blows to a hair surface on the heating assembly through the air supply channel to cool the hair.

In some embodiments, a terminal of the heating assembly is electrically connected with the controller, and the controller is configured to control the heating assembly to heat to stabilize the surface temperature of a rod body.

In some embodiments, the driving mechanism is electrically connected with the controller, and the controller is configured to control the driving mechanism to rotate left and right to drive the hair curling mechanism to rotate and wrap the hair around the heating assembly.

In some embodiments, the driving mechanism includes a motor, a gear, a support member, and a transmission member.

The motor is electrically connected with the controller and arranged in the support member.

A rotating shaft of the motor is connected with the gear.

The gear is embedded in the support member.

The transmission member sleeves an upper end of the support member, and inner teeth of the transmission member mesh with the gear.

In some embodiments, a protruding part is provided on an outward extension of the upper end of the support member.

In some embodiments, the hair curling mechanism is detachably connected with the transmission member.

In some embodiments, the heating assembly includes an isolation member and a heating member.

The heating element is sleeved in the isolation member.

The heating member and the isolation member are arranged in the hair curling mechanism.

In some embodiments, the isolation member forms a penetrating structure. One end of the isolation member is provided with a circular opening, and another end of the isolation member is provided with a Y-shaped opening.

A circular opening side of the isolation member sleeves the outward extension of the upper end of the support member.

In some embodiments, an axially arranged positioning bar is provided on an inner wall of the isolation member.

When the isolation member cooperates with the support member, the positioning bar is embedded in the protruding part of the support member.

In some embodiments, the housing includes a first housing, a second housing, and a limiting housing.

The first housing and the second housing are detachably matched to form a cavity capable of placing the driving mechanism, the hair curling mechanism, and the heating assembly.

The limiting housing is provided at a bottom of the first housing and the second housing to seal the first housing and the second housing.

In some embodiments, a limiting assembly is provided at a top of the first housing and the second housing.

The limiting assembly is configured as the penetrating structure.

In some embodiments, one side of the limiting assembly is provided with a circular hole, and an opposite side of the circular hole is provided with a first slot.

The circular hole is adjacent to a blowing side of the fan assembly.

In some embodiments, a second axially arranged slot is provided on one side of the hair curling mechanism.

The first slot and the second slot are coaxially arranged.

The circular hole, the first slot, and the second slot form the air supply channel.

The air-cooled negative ion hair curler comprises the housing, the driving mechanism, the hair curling mechanism, the heating assembly, and the fan assembly. The air supply channel is provided in the inner hollow structure of the housing. The negative ion airflow delivered by the fan assembly cools the hair through the air supply channel. Compared with the prior art, the fan assembly is additionally arranged based on the existing curling iron, which can quickly deliver the negative ionic wind to the surface of the hair wrapped around the heating rod body, thereby quickly cooling and protecting the hair curled by the high temperature of the rod body to achieve ideal and long-lasting curly hair styling effect. The problem that the design of the curling iron has no negative ion diffusion and transportation, and the negative ions can only be accumulated at the generator and cannot effectively diffuse to the hair, resulting in ineffective use can be effectively solved.

BRIEF DESCRIPTION OF DRAWINGS

The utility model will be further described with reference to the accompanying drawings and embodiments. In the accompanying drawings.

DETAILED DESCRIPTION OF THE EMBODIMENTS

Figure 1:
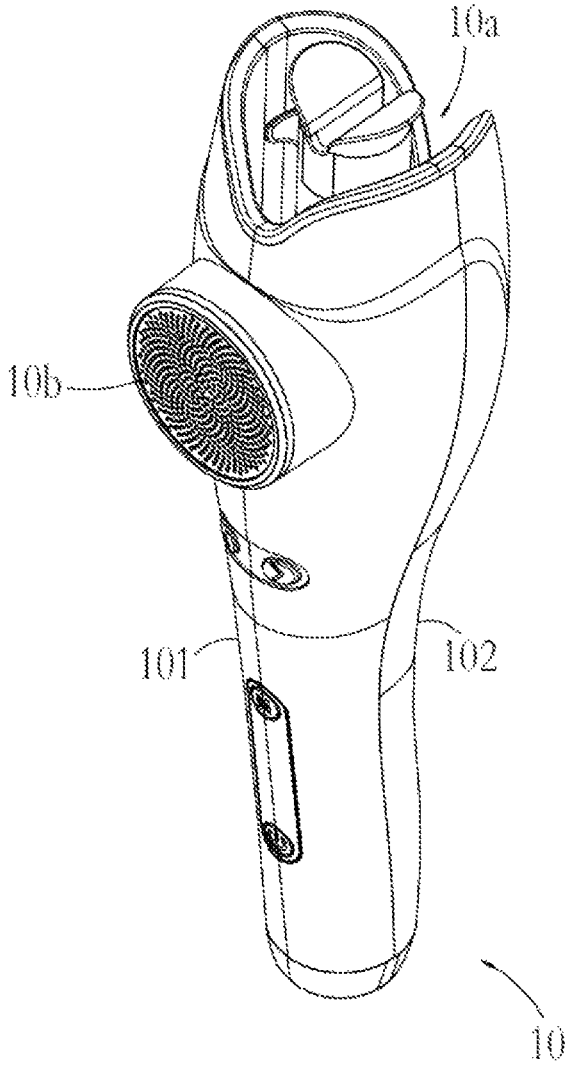
FIG. 1 is a perspective view illustrating an air-cooled negative ion hair curler according to the embodiment of the utility model.
Figure 2:
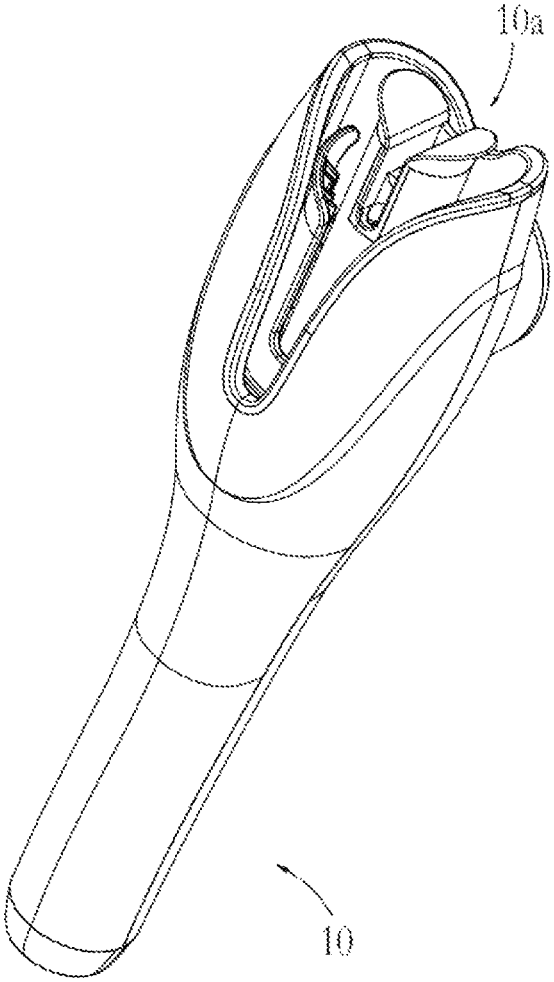
FIG. 2 is a perspective view illustrating an air-cooled negative ion hair curler according to another embodiment of the utility model.

In order to have a clearer understanding of the technical features, purposes, and effects of the present utility model, the specific embodiments of the present utility model will be described in detail with reference to the accompanying drawings.

As shown in FIGS. 1-5, in the first embodiment of the air-cooled negative ion hair curler (10) of the present utility model, the air-cooled negative ion hair curler 10) comprises housings (101, 102), driving mechanisms (110, 120, 130, 150), a hair curling mechanism 160, heating assemblies (170, 180), fan assemblies (210, 211, 212), and negative ion generator 101*b*.

The housings (101, 102) form inner hollow structure (101*a*, 102*a*) for placing the driving mechanisms, the hair curling mechanism, the heating assemblies, the fan assemblies, and negative ion generator 101*b*.

The driving mechanisms (110, 120, 130, 150) are configured to receive a control instruction output by a controller 220. The control instruction is used to control the driving mechanisms (110, 120, 130, 150) to rotate left and right to drive the curling mechanism 160 to rotate to wrap hair to be preheated around the heating assemblies (170, 180).

The heating assemblies (170, 180) are configured to receive a heating instruction output by the controller 220. Under the control of the controller 220, the heating assemblies (170, 180) heat and stabilize temperature of a surface of a rod body to heat the hair wrapped around the heating assemblies (170, 180).

The fan assemblies (210, 211, 212) are configured to receive a switch instruction output by the controller 220.

The fan assemblies (210, 211, 212) are controlled by the controller 220. When preset time of the hair wrapped around the heating assemblies (170, 180) reaches and the hair is curled with high temperature. the fan assemblies (210, 211, 212) rotate to generate an airflow and drive the airflow to blow to the surface of the hair on the rod body through an air supply channel 10*c*, so that the hair quickly cools down.

The negative ion generator 101*b* is configured to generate negative ions and fixed on an air outlet side of the fan assemblies (210, 211, 212). When the airflow passes, the negative ions accumulated at the negative ion generator 101*b* are carried away by the airflow to form negative ionic wind.

Specifically, the housings (101, 102) form the inner hollow structure (101*a*, 102*a*), and an opening structure 10*a* is provided at an upper end of the housings (101, 102). The hair under styling is placed on the hair curling mechanism 160 through the opening structure 10*a*.

The driving mechanisms (110, 120, 130, 150) are arranged in the inner hollow structure (101*a*, 102*a*) of the housings (101, 102). When the controller 220 outputs the control instruction to the driving mechanisms (110, 120, 130, 150), the driving mechanisms (110, 120, 130, 150) are controlled to output left and right rotational torques, which are used to drive the hair curling mechanism 160 to rotate.

Further, the hair curling mechanism 160 is detachably disposed on an upper end of the driving mechanisms (110, 120, 130, 150). The hair curling mechanism 160 is in transmission connection with the driving mechanisms (110, 120, 130, 150). The driving mechanisms (110, 120, 130, 150) drive the hair curling mechanism 160 to rotate to wrap the hair under styling onto the heating assemblies (170, 180). The hair curling mechanism 160 is a sleeve. The sleeve comprises an annular ring 161 and a pair of legs (162*a*. 162*b*) protruding outwardly from the annular ring 161.

A lower end of the hair curling mechanism 160 is provided with a through hole 160*a*. One end of each of the heating assemblies (170, 180) is detachably disposed above the driving mechanisms (110, 120, 130, 150) and configured to heat the hair under styling so that the hair under styling is styled in shape.

Further, the fan assemblies (210, 211, 212) are detachably provided on one side of the housings (101, 102) to form an airflow.

An air supply channel 10*c* is provided in the inner hollow structure of the housings (101, 102). The negative ion airflow delivered by the fan assemblies (210, 211, 212) cools the hair through the air supply channel 10*c*.

Specifically, when the hair wrapped around the heating assemblies (170, 180) is continuously blown by the airflow of the fan assemblies (210, 211, 212) for 4-6 seconds, the temperature of the hair surface can quickly drop by about 50° C. (from 190° C. to 140° C.). In this way, the curly effect of the hair after air cooling is more durable than that of ordinary curling irons, and the styling effect can be maintained for about 4 hours.

With application of the technical solution, the fan assemblies (210, 211, 212) are provided on one side of the housing (101, 102). Under the control of the controller 220, the fan assemblies (210, 211, 212) blow air to the hair curled by high temperature on the surface of the heating assemblies (170, 180) from the side of the hair curling chamber 10*d* through the air supply channel 10*c* to quickly cool down using air cooling, so that an ideal long-lasting styling of the hair can be obtained, and the risk of high temperature damage to the hair for a long time can also be avoided. The problem that the curling iron has no design of negative ion diffusion and transportation, thus the negative ions can only be accumulated at the generator and cannot effectively diffuse to the hair, resulting in unsatisfactory use result can be effectively solved.

Figure 3:
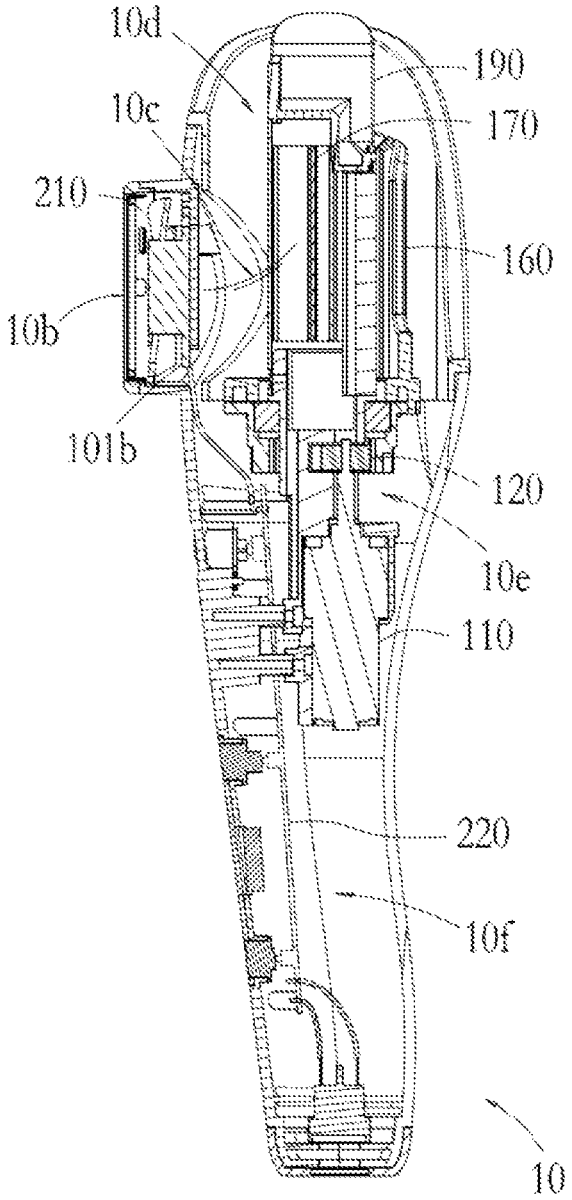
FIG. 3 is a cross-sectional view illustrating an air-cooled negative ion hair curler according to the embodiment of the utility model.

In some embodiments, as shown in FIG. 3, in order to prevent hair from being damaged by a lasting high temperature, the air supply channel 10*c* can be provided in the housing (101, 102). One side of the air supply channel 10*c* is arranged adjacent to the fan assemblies (210, 211, 212), and the other side of the air supply channel 10*c* is arranged adjacent to the hair curling mechanism 160.

When the fan assemblies (210, 211, 212) work. the airflow enters the housings (101, 102) through the air inlet side 10*b*, and the airflow is sent to the surface of the heating assemblies (170, 180) through the air supply channel 10*c* to cool the styling hair after heating.

Specifically, the fan assemblies (210, 211, 212) are additionally arranged on the side of the housings (101, 102), so that the airflow blown by the fan assemblies (210, 211, 212) can flow from the side of the housings (101, 102) onto the heating assemblies (170, 180).

It should be noted that this side is not necessarily aside facing the heating assemblies (170, 180). It can be an angle direction of the fan assemblies (210, 211, 212) that is slightly inclined upward or downward, as long as the airflow can directly blow onto the heating assemblies (170, 180).

In some embodiments, as shown in FIG. 3, the air-cooled negative ion hair curler (10) further comprises the negative ion generator 101*b* configured to generate negative ions.

Specifically, the negative ion generator 101*b* is detachably fixed on the air outlet side of the fan assemblies (210, 211, 212). When the fan assemblies (210, 211, 212) deliver the airflow, and the airflow may take away the accumulated negative ions to form the negative ionic wind acting on the hair surface after heating.

In some embodiments, as shown in FIG. 3, at least a curling chamber 10*d*, a driving mechanism chamber 10*e*, and a controller chamber 10*f* are provided in the housings (101, 102).

The heating assemblies (170, 180) are axially arranged in the curling chamber 10*d* and configured to heat the hair under styling.

The driving mechanisms (110, 120, 130, 150) are axially arranged in the driving mechanism cavity 10*c* and configured to output rotational torques.

The controller 220 is axially arranged in the controller chamber 10*f* and configured to output a control signal to control the operation of the whole machine, specifically including parameter setting, temperature adjustment, driver rotation, fan rotation, negative ion start/stop, etc.

Figure 4:
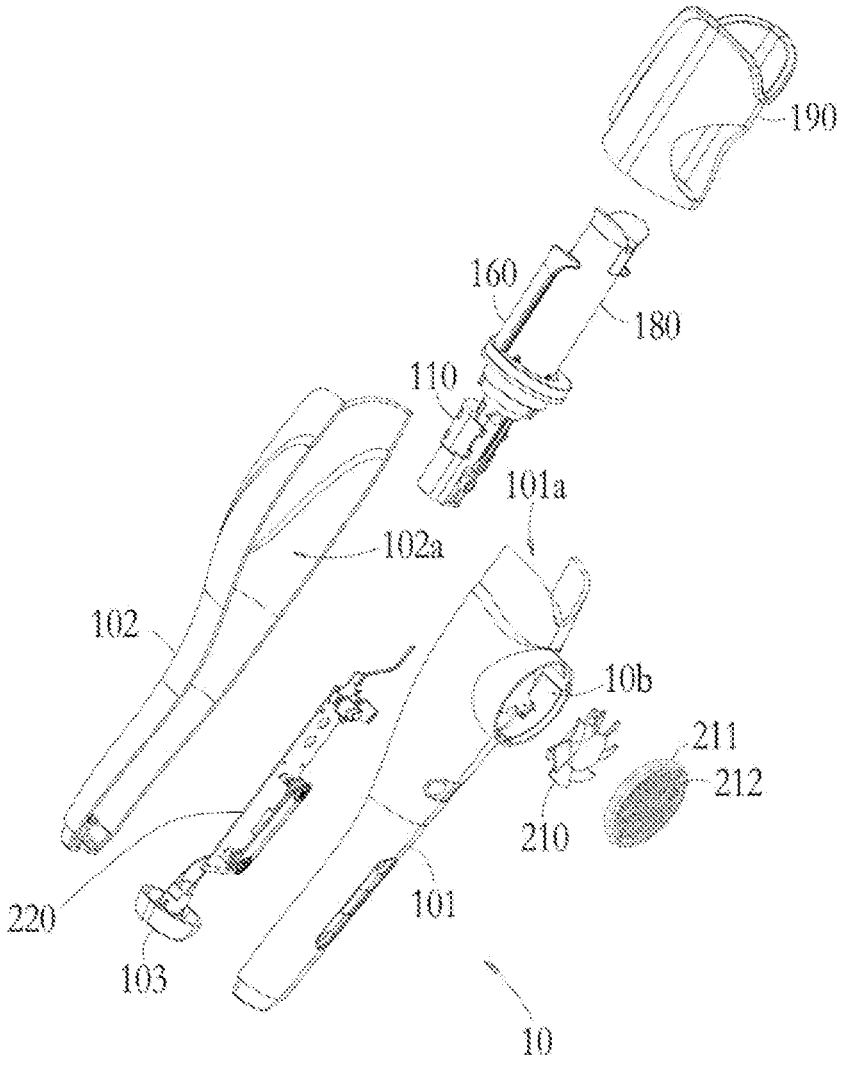
FIG. 4 is an exploded view illustrating an air-cooled negative ion hair curler according to the embodiment of the utility model.

In some embodiments, as shown in FIG. 4, in order to achieve an ideal long-lasting styling for the hair, a signal terminal of the fan assemblies (210, 211, 212) may be electrically connected with a signal output terminal of the controller 220. The fan assemblies are controlled by the controller 220. When the preset time for preheating the hair wrapped around the heating assemblies (170, 180) reaches, the fan assemblies (210, 211, 212) are controlled to rotate and drive the air low. The airflow blows to the hair surface on the heating assemblies (170, 180) through the air supply channel 10*c* to cool the hair.

The fan assemblies (210, 211, 212) include a fan 210, a circular bracket 211, and an air inlet net 212.

The fan 210 is arranged on an air inlet side 10*b* of a side of the housings (101, 102).

The circular bracket 211 is embedded in the air inlet side 10*b* of the housings (101, 102) and fixed on the housings (101, 102).

The air inlet net 212 is installed in the circular bracket 211.

That is to way, when the fan 210 is controlled to rotate, an external airflow is delivered the air supply channel 10*c* through the air inlet net 212.

Figure 5:
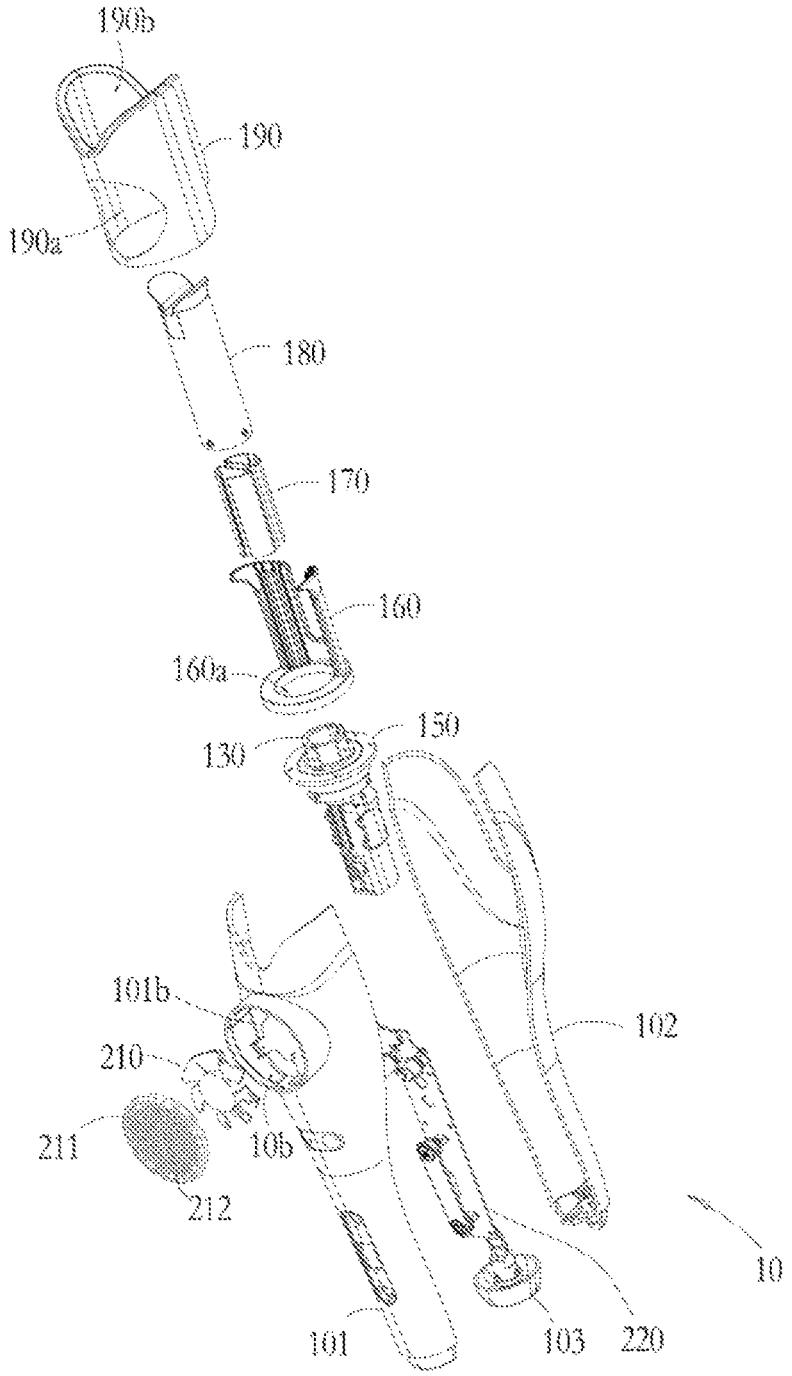
FIG. 5 is an exploded view illustrating an air-cooled negative ion hair curler according to another embodiment of the utility model.

In some embodiments, as shown in FIG. 5, a power terminal of the heating assemblies (170, 180) is electrically connected with the signal output terminal of the controller 220. Under the control of the controller 220, the heating assemblies (170, 180) are controlled to be heated (about 190° C.) to stabilize the surface temperature of the rod body and heat the hair under styling.

Figure 6:
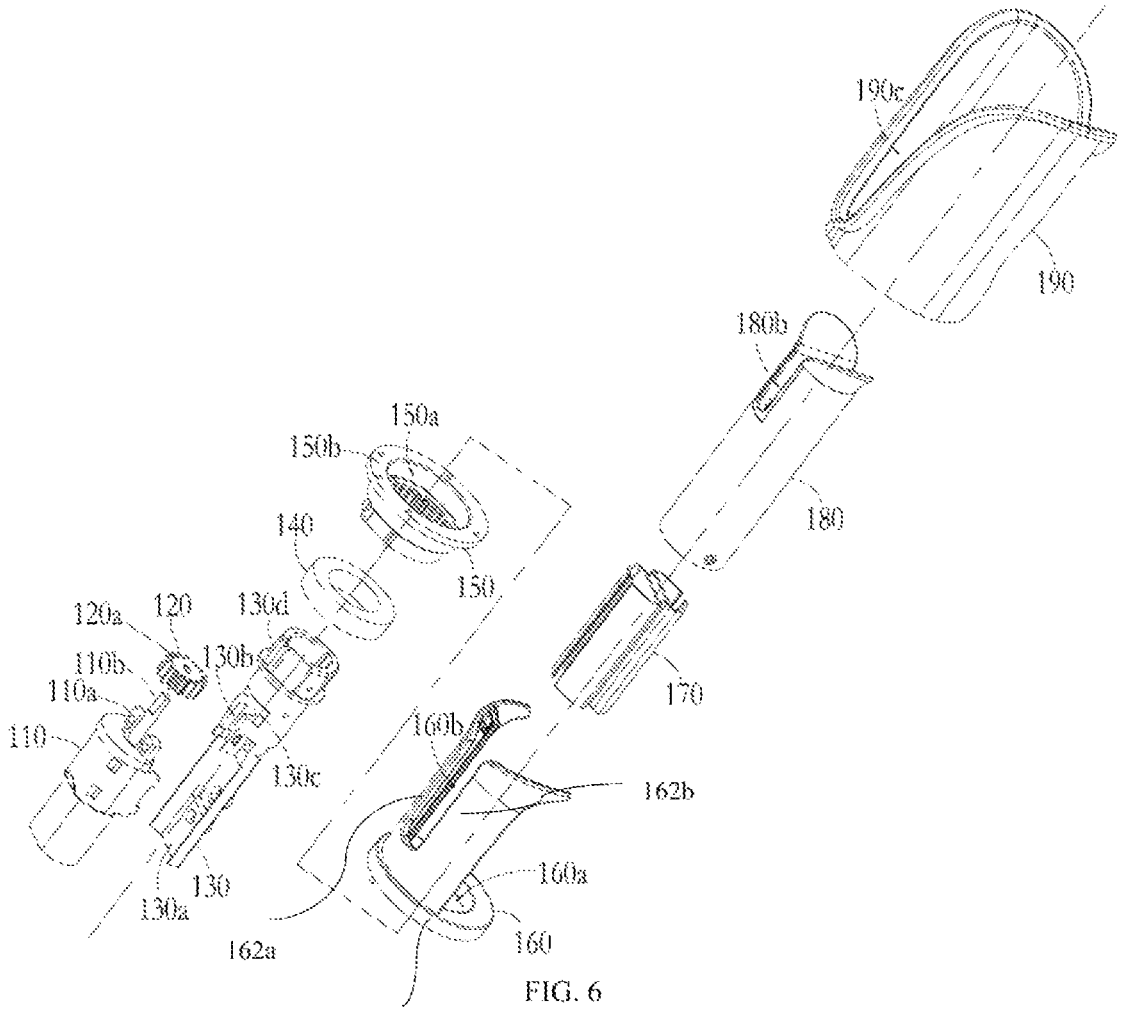
FIG. 6 is an exploded view illustrating an air-cooled negative ion hair curler according to another embodiment of the utility model.

In some embodiments, as shown in FIG. 6, the driving mechanisms (110, 120, 130, 150) are electrically connected with the controller 220 and controlled by the controller 220 to control the driving mechanisms (110, 120, 130, 150) to rotate left and right to drive the hair curling mechanism 160 to rotate and wrap the hair around the heating assemblies (170, 180).

Further, the driving mechanisms include a motor 110, a gear 120, a support member 130, and a transmission member 150.

Figure 7:
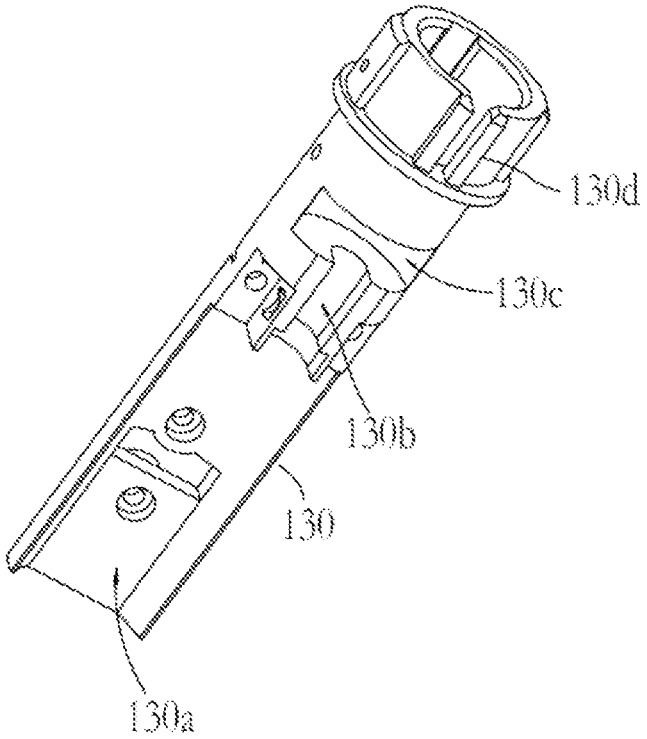
FIG. 7 is a perspective view illustrating a support member according to the embodiment of the utility model.

As shown in FIG. 7, a lower side of the support member 130 is provided with an open structure 130*a*, and a middle section of the support member 130 is provided with a groove

130*b*. An upper end of the groove 130*b* is provided with a transverse groove 130*c*, and a protruding part 130*d* is arranged on an outward extension of an upper end of the transverse groove 130*c*.

The motor 110 is detachably installed in the open structure 130*a* of the support member 130 through a fixing terminal 110*a*. A rotating shaft 110*b* of the motor 110 is clamped the groove 130*b*.

Further, a signal end of the motor 110 is electrically connected with a control signal end of the controller 220 to receive a control instruction input by the controller 220.

The gear 120 is embedded in the transverse groove 130*c* of the support member 130.

The rotating shaft 110*b* of the motor 110 is connected with the gear 120. A through hole 120*a* is disposed at the center of the gear 120. The rotating shaft 110*b* of the motor 110 penetrates through the through hole 120*a* of the gear 120. The rotational torques are exerted on the gear 120 through the rotating shaft 110*b* to drive the gear 120 to rotate.

The transmission member 150 sleeves the upper end of the support member 130, and inner teeth 150*b* of an opening 150*a* of the transmission member 150 mesh with the gear 120.

A sealing ring 140 is provided between the transmission member 150 and the support member 130. The sealing ring 140 is provided at the upper end of the support member 130 and fit with a lower end of the transmission member 150.

That is, when the motor 110 rotates, the rotational torques are applied to the gear 120 through the rotating shaft 110*b* to drive the gear 120 to rotate. The rotating gear 120 then drives the transmission member 150 to rotate, thereby controlling the hair curling mechanism 160 to rotate left and right to wrap the hair around the heating assemblies (170, 180).

In some embodiments, as shown in FIG. 6, the hair curling mechanism 160 is detachably connected with the transmission member 150.

Figure 8:
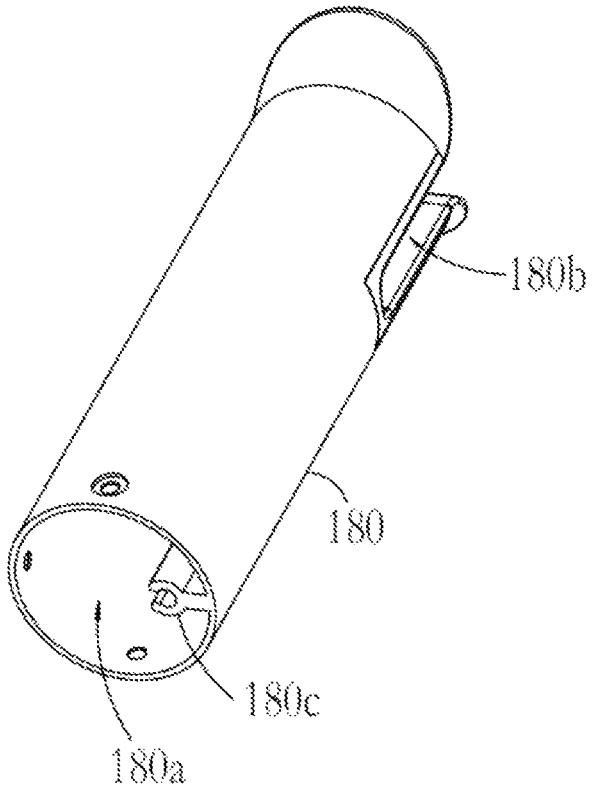
FIG. 8 is a perspective view illustrating an isolation member according to the embodiment of the utility model.

In some embodiments, as shown in FIG. 6 and FIG. 8, the heating assembly includes a heating element 170 and an isolation member 180. The isolation member 180 forms a penetrating structure. One end of the isolation member 180 is provided with a circular opening 180*a*, and another end of the isolation member 180 is provided with a Y-shaped opening 180*b*.

Specifically, the heating member 170 is sleeved in the isolation member 180.

The heating member 170 and the isolation member 180 are arranged in the hair curling mechanism 160.

Further, the side of the circular opening 180*a* of the isolation member 180 sleeves an outward extension of the upper end of the support member 130.

In some embodiments, as shown in FIG. 6 and FIG. 8, in order to improve the assembly stability of the isolation member 180, an axially arranged positioning bar 180*c* may be provided on an inner wall of the isolation member 180.

Specifically, when the isolation member 180 cooperates with the support member 130, the positioning bar 180*c* is embedded in the protruding part 130*d* of the support member 130, and the isolation member 180 is positioned through the protruding part 130*d*.

In some embodiments, as shown in FIG. 5, the housings (101, 102) include a first housing 101, a second housing 102, and a limiting housing 103.

The first housing 101 and the second housing 102 are detachably matched to form a cavity capable of placing the driving mechanisms, the hair curling mechanism 160, and the heating assemblies.

The fan assemblies (210, 211, 212) are additionally arranged on a side of the first housing 101, so that the fan assemblies (210, 211, 212) blow airflow in from the side of the first housing 101, and then onto the heating assemblies (170, 180) through the air supply channel 10.

The limiting housing 103 is provided at a bottom of the first housing 101 and the second housing 102 for sealing the first housing 101 and the second housing 102.

In some embodiments, as shown in FIG. 4, the limiting assembly 190 is provided on a top of the first housing 101 and the second housing 102.

The limiting assembly 190 is configured as a penetrating structure 190*b*. The penetrating structure 190*b* is configured to limit an isolation member 180.

Figure 9:
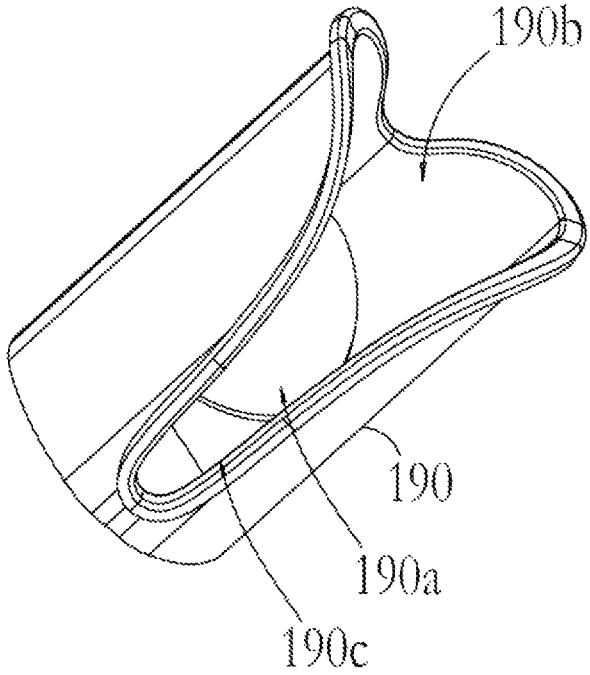
FIG. 9 is a perspective view illustrating a limiting assembly according to the embodiment of the utility model.

As shown in FIG. 9, a circular hole 190*a* is provided on one side of the limiting assembly 190, and an opposite side of the circular hole 190*a* is provided with a first slot 190*c*.

The circular hole 190*a* is arranged adjacent to a blowing side of the fan 210 (belonging to the fan assemblies).

In some embodiments, as shown in FIG. 6, an axially arranged second slot 160*b* is provided on one side of the hair curling mechanism 160.

The first slot 190 and the second slot 160*b* are coaxially arranged. The circular hole 190*a*, the first slot 190*c*, and the second slot 160*b* form the air supply channel 10*c*.

The embodiments of the present utility model have been described with reference to the accompanying drawings. However, the present utility model is not limited to the specific embodiments. The specific embodiments are only illustrative and not limiting. Under the guidance of the utility model, those having ordinary skills in the art may also make many forms without departing from the purpose of the present utility model and the scope of protection claimed by the claims. These all fall within the scope of protection of the present utility model.

What is claimed is:

1. An air-cooled negative ion hair curler, comprising:

a housing of which an inner hollow structure is formed inside and an open structure is disposed at an upper end;

a driving mechanism arranged in the inner hollow structure of the housing and configured to output left and right rotational torques, wherein the driving mechanism includes a motor, a gear, a support member, and a transmission member;

a sleeve arranged at an upper end of the driving mechanism and in transmission connection with the driving mechanism, wherein the sleeve comprises an annular ring and a pair of legs protruding outwardly from the annular ring;

a heating assembly arranged above the driving mechanism and configured to generate heat for hair to be heated; and a fan assembly arranged on one side of the housing and configured to form an airflow;

wherein, an air supply channel is disposed in the inner hollow structure of the housing, and a negative ion airflow delivered by the fan assembly cools the hair on the heating assembly through the air supply channel.

2. The air-cooled negative ion hair curler according to claim 1, further comprising:

a negative ion generator, wherein the negative ion generator is fixed on an air outlet side of the fan assembly, and when the airflow delivered by the fan assembly flows, the airflow takes away accumulated negative ions to form negative ionic wind.

3. The air-cooled negative ion hair curler according to claim 1, wherein, the housing is provided with at least a hair curling chamber, a driving mechanism chamber, and a controller chamber for placing a controller;

the heating assembly is arranged in the hair curling chamber; and the driving mechanism is arranged in the driving mechanism chamber.

4. The air-cooled negative ion hair curler according to claim 3, wherein a terminal of the fan assembly is electrically connected with the controller and controlled by the controller, and after preset time for preheating hair wrapped around the heating assembly reaches, the fan assembly is controlled to rotate to drive the airflow, and the airflow blows to a hair surface on the heating assembly through the air supply channel to cool the hair.

5. The air-cooled negative ion hair curler according to claim 3, wherein a terminal of the heating assembly is electrically connected with the controller, and the controller is configured to control the heating assembly to heat to stabilize surface temperature of a rod body.

6. The air-cooled negative ion hair curler according to claim 3, wherein the driving mechanism is electrically connected with the controller, and the controller is configured to control the driving mechanism to rotate left and right to drive the the sleeve to rotate and wrap the hair around the heating assembly.

7. The air-cooled negative ion hair curler according to claim 6, wherein the motor is electrically connected with the controller and arranged in the support member;

a rotating shaft of the motor is connected with the gear;

the gear is embedded in the support member; and the transmission member sleeves an upper end of the support member, and inner teeth of the transmission member mesh with the gear, wherein when the motor rotates, rotational torques are applied to the gear through the rotating shaft to rotate the gear, wherein the gear drives the transmission member to rotate, thereby controlling the sleeve to rotate left and right to wrap the hair around the heating assembly.

8. The air-cooled negative ion hair curler according to claim 7, wherein a protrusion part is arranged at an outward extension of the upper end of the support member.

9. The air-cooled negative ion hair curler according to claim 8, wherein the sleeve is detachably connected with the transmission member.

10. The air-cooled negative ion hair curler according to claim 9, wherein the heating assembly includes an isolation member and a heating member;

the heating member is sleeved in the isolation member; and the heating member and the isolation member are arranged in the sleeve.

11. The air-cooled negative ion hair curler according to claim 10, wherein the isolation member forms a penetrating structure, one end of the isolation member is provided with a circular opening, and another end of the isolation member is provided with a Y-shaped opening; and a circular opening side of the isolation member sleeves the outward extension of the upper end of the support member.

12. The air-cooled negative ion hair curler according to claim 11, wherein an axially arranged positioning bar is provided on an inner wall of the isolation member; and when the isolation member cooperates with the support member, the positioning bar is embedded in the protruding part of the support member.

13. The air-cooled negative ion hair curler according to claim 1, wherein housing includes a first housing, a second housing, and a limiting housing;

the first housing and the second housing are detachably matched to form a cavity capable of placing the driving mechanism, the sleeve, and the heating assembly; and the limiting housing is provided at a bottom of the first housing and the second housing and configured to seal the first housing and the second housing.

14. The air-cooled negative ion hair curler according to claim 13, wherein a limiting assembly is arranged at a top of the first housing and the second housing; and the limiting assembly is configured as the penetrating structure.

15. The air-cooled negative ion hair curler according to claim 14, wherein one side of the limiting assembly is provided with a circular hole, and an opposite side of the circular hole is provided with a first slot; and the circular hole is adjacent to a blowing side of the fan assembly.

16. The air-cooled negative ion hair curler according to claim 15, wherein a second axially arranged slot is provided on one side of the sleeve;

the first slot and the second slot are coaxially arranged; and the circular hole, the first slot and the second slot form the air supply channel.

* * * * *